US006384673B1

(12) United States Patent
Dick et al.

(10) Patent No.: US 6,384,673 B1
(45) Date of Patent: May 7, 2002

(54) CURRENT MIRROR ARRANGEMENT

(75) Inventors: Burkhard Dick, Hamburg; Dieter Janta, Halstenbek, both of (DE)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/763,840

(22) PCT Filed: Jun. 29, 2000

(86) PCT No.: PCT/EP00/06071

§ 371 Date: Feb. 27, 2001

§ 102(e) Date: Feb. 27, 2001

(87) PCT Pub. No.: WO01/02925

PCT Pub. Date: Jan. 11, 2001

(30) Foreign Application Priority Data

Jul. 1, 1999 (DE) ..... 199 30 381

(51) Int. Cl.[7] ..... G05F 1/10; G05F 3/02
(52) U.S. Cl. ..... 327/543; 323/315
(58) Field of Search ..... 327/538, 540, 327/541, 543; 323/312, 313, 315; 330/288

(56) References Cited

U.S. PATENT DOCUMENTS 4,801,892 A * 1/1989 Yamakashi et al. ..... 330/288
5,512,815 A * 4/1996 Schrader ..... 323/315
5,627,732 A 5/1997 Lob et al. ..... 363/16
5,682,094 A * 10/1997 Beier et al. ..... 323/315

OTHER PUBLICATIONS

"Halbleiter–Schasltungstechnik" by U. Tietze et al., 1986, pp. 62–64.

* cited by examiner

*Primary Examiner*—Toan Tran
*Assistant Examiner*—Quan Tra
(74) *Attorney, Agent, or Firm*—Aaron Waxler

(57) ABSTRACT

A current mirror arrangement including an input current path comprising a main current path of a first current mirror transistor and a transistor connected thereto in a cascode configuration and referred to as first cascode transistor, an output current path comprising a main current path of a second current mirror transistor and a transistor connected thereto in a cascode configuration and referred to as second cascode transistor, the current mirror transistors being interconnected in a current mirror configuration and their control terminals being connected to a first circuit point, the connected control terminals of the cascode transistors being interconnected and being connected to an input terminal in the input current path of the current mirror arrangement, the input terminal being constituted by a terminal of the main current path of the first cascode transistor, and an output terminal being constituted by a terminal of the main current path of the second cascode transistor, and a current splitting circuit for deriving a part of a current from the first circuit point in the output terminal, the current splitting circuit is adapted to split up the current from the first circuit point directly to the output terminal and a reference point.

6 Claims, 1 Drawing Sheet

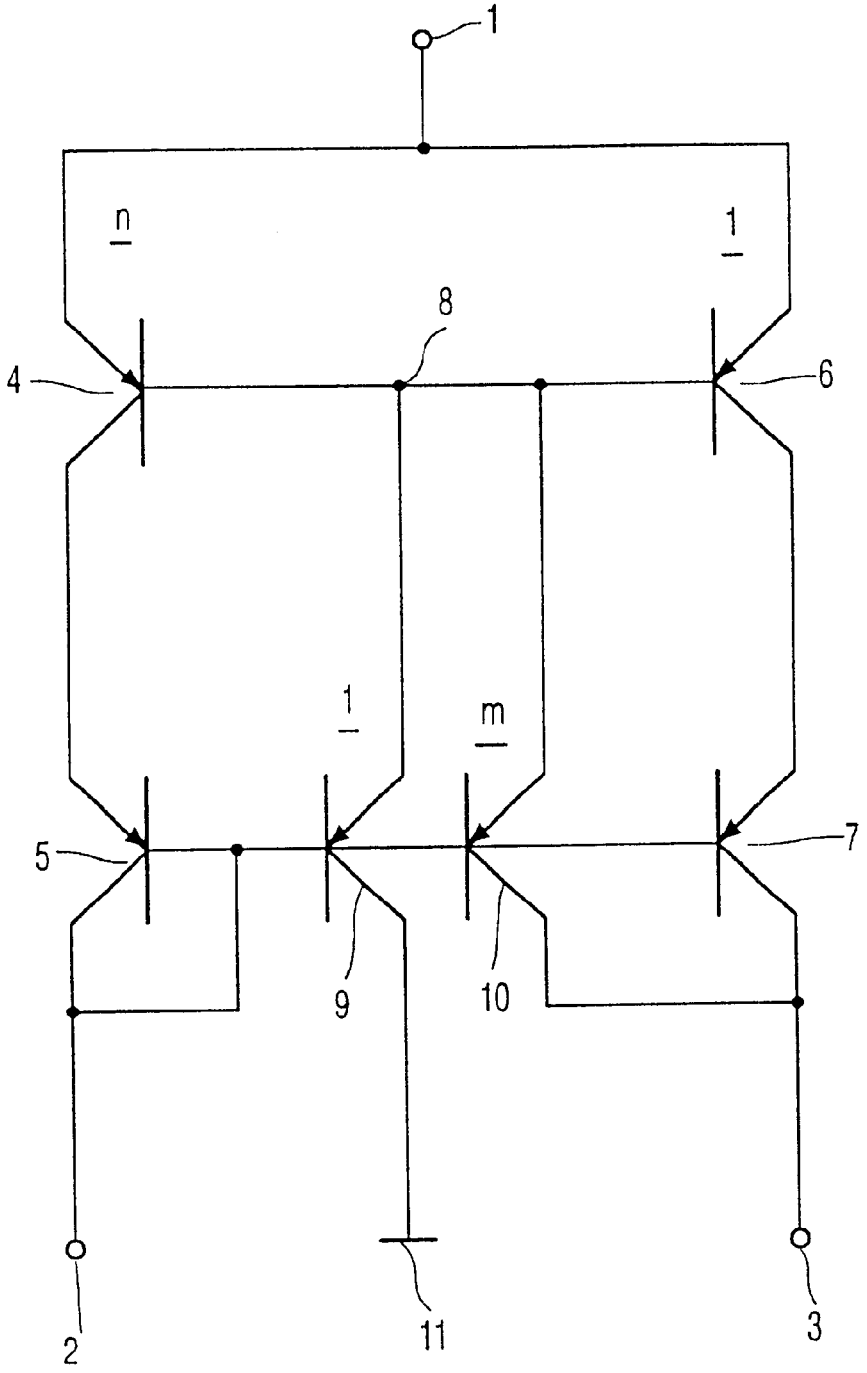
1
n
1
8
4
6
1
m
5
7
9
10
2
11
3

CURRENT MIRROR ARRANGEMENT

The invention relates to a current mirror arrangement comprising an input current path comprising a main current path of a first current mirror transistor and a transistor connected thereto in a cascode configuration and referred to as first cascode transistor, an output current path comprising a main current path of a second current mirror transistor and a transistor connected thereto in a cascode configuration and referred to as second cascode transistor, the current mirror transistors being interconnected in a current mirror configuration and their control terminals being connected to a first circuit point, the connected control terminals of the cascode transistors being interconnected and being connected to an input terminal in the input current path of the current mirror arrangement, the input terminal being constituted by a terminal of the main current path of the first cascode transistor remote from the first current mirror transistor, and an output terminal being constituted by a terminal of the main current path of the second cascode transistor remote from the second current mirror transistor, a dimensioning of the current mirror and cascode transistors for a current in the input current path, which corresponds at least substantially to the n-fold value of the current in the output current path, and a current splitting circuit for deriving a part of a current from the first circuit point in the output terminal.

Current mirror arrangements are used in transistor circuitry techniques for diverting, multiplying or changing reference currents by a defined factor. The deviation of the output current from the input current or from the desired multiple of the input current is dependent on different influences, of which the compensation of the control currents of the transistors or—in the case of bipolar transistors—the compensation of the Early voltages are very important. These influences can be counteracted preferably by a symmetrical configuration of the current mirror arrangements, but this is at the expense of the number of components to be used and the minimally required power supply voltage.

A current mirror comprising two bipolar transistors whose emitters are interconnected at one end and whose bases are interconnected at the other end is known from the article "Halbleiter-Schaltungstechnik" by U. Tietze and Ch. Schenk, $8^{th}$ edition, Springer-Verlag, 1986, pp. 62 to 64. Moreover, the base and the collector of the input transistor are interconnected. In this simple current mirror arrangement, the current mirror ratio is distorted by the base currents of the two transistors flowing via the input.

When such a current mirror arrangement is augmented with a further transistor whose emitter is connected to the coupled bases of the current mirror transistors, whose base is connected to the input and the collector is connected to a reference potential, the error in the current mirror ratio with respect to the base current of the additional transistor is reduced. Particularly for current mirrors consisting of PNP transistors having comparably small current gains, this error may still be too large for given applications.

A current mirror known as Wilson current mirror, in which a further transistor is arranged in a cascode configuration in addition to the current mirror transistor in the output branch is also known from said article "Halbleiter-Schaltungstechnik". The connected bases of the current mirror transistors are connected to this cascode branch and the control terminal of the cascode transistor is connected to the input branch. A considerable base current compensation for a mirror ratio of 1 can be achieved with this circuit. However, there are distortions due to the Early voltages. It is true that, due to the addition of a further transistor arranged as a diode in the input branch of the Wilson current mirror in such a way that this transistor is cascode arranged with respect to the current mirror transistor in the input branch, the influence of Early voltages on the current mirror transistors of the Wilson current mirror can be suppressed. Nevertheless, an exact compensation of the base currents and hence a flawless current ratio is obtained only for a value of at least substantially 1 of this current ratio.

A current mirror with an input branch and at least two output branches with PNP mirror transistors is known from U.S. Pat. No. 5,627,732. Each of these current mirror transistors is arranged in a cascode configuration with a cascode transistor. In FIG. 4 of U.S. Pat. No. 5,627,732, the base currents of the current mirror transistors are collected and applied to a common emitter of a current distribution transistor denoted by the reference sign T7. This current distribution transistor is constituted as a multicollector transistor. The collected base currents of the current mirror transistors are equally distributed to the output terminals of the output branches of the current mirror. Due to such a distribution, however, no exact compensation of the base currents and hence the current mirror error is obtained. An error is left in the current mirror ratio between the output current paths and the input current path. To obviate this drawback, U.S. Pat. No. 5,627,732 proposes various circuits with reference to FIGS. 5, 6 and 8 in this document. Particularly FIG. 8 shows an arrangement which should ensure both an exact current mirror ratio and an independence of variations of the input current of the current mirror and should simultaneously generate current mirror ratios different from 1. However, this is at the expense of a proportionally large number of components.

It is an object of the invention to construct a current mirror arrangement of the type described in the opening paragraph in such a way that it has an exact current mirror ratio of more than 1 between an input current path and an output current path, and can be built with a small number of components and for a low power supply voltage.

According to the invention, in a current mirror arrangement of the type described in the opening paragraph, this object is solved in that n is larger than 1, the current splitting circuit is adapted to split up the current from the first circuit point directly to the output terminal and a reference point in a ratio of m:1, in which the relation $m=1/(n-1)$ is at least substantially satisfied for m.

In the current mirror arrangement according to the invention, the current splitting circuit is connected to the control terminals of the current mirror transistors and the cascode transistors in such a way that symmetrical potential ratios are adjusted in the input current path and in the output current path during operation. In a construction of the transistors used in a bipolar circuit technique, the effects due to Early voltages are thereby reduced; errors caused thereby in the current mirror ratio do not occur. For the selected range of values of the factor n, for which the current in the input current path is larger than the current in the output current path, an error current caused by the currents in the control terminals of the cascode transistors is compensated by adding a predetermined part of the sum of the currents from the control terminals of the current mirror transistors to the current in the output terminal. The indicated relation between m and n applies exactly only to transistors having very large current gains. While taking finite values for the current gain B into account, the following equation is obtained for the relation between the factors m and n:

$$m=(B+1)/(B\cdot(n-1)-1).$$

With the current mirror arrangement according to the invention, the desired current mirror ratio is precisely maintained without any deviations due to currents in the control terminals of the transistors. The current mirror arrangement according to the invention requires a very small number of components. The current mirror arrangement according to the invention can be operated at very small power supply voltages. Due to a small variation of the factor m, i.e. the factor which is essential for the split-up of the current in the current splitting circuit, influences on the current mirror ratio between the input current path and the output current path may also be compensated, which influences are due to different potentials at the input terminal and the output terminal.

In a variant of the current mirror arrangement according to the invention, in which the current in the output current path is to be chosen to be larger than the current in the input current path, and in which the factor n determining this current mirror ratio is thus smaller than 1, error currents can be compensated by the currents from the control terminals of the cascode transistors in such a way that a part of the currents, determined in a comparable way, from the control terminals of the current mirror transistors is applied to the input terminal.

In a further advantageous embodiment, the current mirror arrangement according to the invention is formed in such a way that the current splitting circuit comprises a transistor arrangement having a first and a second current path, both of which are connected at one end to the first circuit point, the first current path is connected at the other end to the reference point and the second current path is connected at the other end to the output terminal, while the current paths are dimensioned for a ratio of the currents conveyed thereby of m:1 between the second and the first current path.

This current splitting circuit is formed in a very simple way. It may be further improved in such a way that the first current path of the current splitting circuit is constituted by the main current path of a first splitting transistor, and the second current path of the current splitting circuit is constituted by the main current path of a second splitting transistor, and that the first and the second splitting transistor are interconnected in a current mirror configuration and their control terminals are connected to the input terminal. A variant of this embodiment is characterized in that the first and the second current path in a transistor are formed with two main current paths and a common control terminal, and the control terminal is connected to the input terminal.

Current mirror arrangements are preferably formed with bipolar transistors. In a corresponding further embodiment, the transistors in the current mirror arrangement according to the invention are accordingly formed as bipolar transistors. The invention is very advantageous in a current mirror arrangement with PNP transistors because smaller current gains B and thus larger base currents occur frequently, whose exact compensation is very important.

In the current mirror arrangement according to the invention, the factors m and n described hereinbefore generally define the current mirror ratio or the current splitting ratio to be adjusted in the current splitting circuit. In a construction with bipolar transistors, these current ratios can be easily realized by ratios of the emitter and collector areas of the corresponding transistors. An advantageous further embodiment of the invention is therefore characterized in that the emitter and collector areas of the first current mirror transistor and the first cascode transistor correspond to the n-fold value of the emitter and collector areas of the second current mirror transistor and the second cascode transistor, and in that the emitter and collector areas arranged in the first and the second current path of the current splitting circuit are chosen in a mutual ratio of 1:m. Although the significance of the factors m and n as area factors is selected on the basis of this relation, their significance for the teachings of the invention is not limited to the definition of areas.

These and other aspects of the invention are apparent from and will be elucidated with reference to the embodiments described hereinafter.

In the drawing:

The sole FIGURE shows a current mirror arrangement having an input current path between a power supply terminal 1 and an input terminal 2 and an output current path between the power supply terminal 1 and an output terminal 3. In the input current path, the main current paths of a first current mirror transistor 4 and a first cascode transistor 5 are interconnected in a cascode configuration, i.e. they are arranged in series. In the output current path, the main current paths of a second current mirror transistor 6 and a second cascode transistor 7 are arranged in a corresponding manner in series in a cascode configuration. In the embodiment, the transistors 4, 5, 6, 7 are formed as bipolar transistors of the PNP type. In a corresponding manner, their main current paths are constituted by the collector-emitter paths of these transistors between the collector and the emitter. The base of the transistor constitutes an associated control terminal.

In the embodiment, the current mirror transistors 4, 6 are interconnected in a current mirror configuration. To this end, the emitters of the current mirror transistors 4 and 6 are connected to the power supply terminal 1. The bases of the current mirror transistors 4, 6 are connected to a first circuit point 8. The collectors of the current mirror transistors 4 and 6 are connected to the emitters of the associated cascode transistors 5 and 7, respectively. The collector of the first cascode transistor 5 is connected to the input terminal 2, the collector of the second cascode transistor 7 is connected to the output terminal 3. The bases of the cascode transistors 5, 7 are interconnected and also connected to the input terminal 2. To adjust a desired current mirror ratio between the current in the input terminal 2 and the current in the output terminal 3 during operation, the emitter areas of the first current mirror transistor 4 and the first cascode transistor 5 are chosen to be the n-fold value of the emitter areas of the second current mirror transistor 6 of the second cascode transistor 7. The factor n is fixed to be larger than 1. The embodiment shown in the Figure further comprises a current splitting circuit consisting of a first splitting transistor 9 and a second splitting transistor 10. Due to this current splitting circuit, the sum of the currents in the bases of the current mirror transistors 4, 6 is drained in operation via the first circuit point 8 and split up at a reference point 11, in this example ground, and the output terminal 3. To this end, the current splitting circuit, together with the splitting transistors 9, 10, forms a first current path leading from the first circuit point 8 via the collector-emitter path of the first splitting transistor 9 to the reference point 11, and a second current path leading from the first circuit point 8 via the collector-emitter path of the second splitting transistor 10 to the output terminal 3. These current paths are dimensioned for a ratio of the currents conveyed in these paths of m:1 between the second and the first current path. In the embodiment shown, the splitting transistors 9, 10 are also formed as bipolar transistors of the PNP type. They have emitter areas which are fixed in a ratio of m:1. Due to this factor m, a part of the current derived from the first circuit point 8 is applied to the reference point 11 and the rest of this current, corresponding to the m-fold value of the current at the reference point 11, is applied to the output terminal 3. To this end, the splitting transistors 9, 10 are interconnected in a current mirror configuration, i.e. their emitters are connected at one end to the first circuit point 8 and their bases are connected at the other end to the input terminal 2. The relation $M=1/(n-1)$ approximately holds for the factors m and n as well as for the current gain B of the transistors, or, more precisely, the equation $$m=(B+1)/(B\cdot(n-1)-1)$$

while taking the current gain B into account and assuming that there are equal current gains for all transistors in the circuit arrangement. In such a dimensioning of the current mirror arrangement, the current in the input terminal 2 exactly corresponds to the n-fold value of the current in the output terminal 3.

In a modification of the embodiment shown, the splitting transistors 9, 10 may be combined to one transistor with two main current paths which then constitute the two current paths of the current splitting circuit. Such a transistor is formed with an emitter and two collectors as well as with a common control terminal (base). The control terminal is again connected to the input terminal 2. The collector of this transistor constituting one end point of the first current path is connected to the reference point 11 and the second collector is connected to the output terminal 3. The collector areas of the first and second current paths in this transistor are dimensioned in a ratio of 1:m, where the above-mentioned relations hold for m.

What is claimed is:

1. A current mirror arrangement comprising an input current path comprising a main current path of a first current mirror transistor and a transistor connected thereto in a cascode configuration and referred to as first cascode transistor, an output current path comprising a main current path of a second current mirror transistor and a transistor connected thereto in a cascode configuration and referred to as second cascode transistor, the current mirror transistors being interconnected in a current mirror configuration and their control terminals being connected to a first circuit point, the connected control terminals of the cascode transistors being interconnected and being connected to an input terminal in the input current path of the current mirror arrangement, the input terminal being constituted by a terminal of the main current path of the first cascode transistor remote from the first current mirror transistor, and an output terminal being constituted by a terminal of the main current path of the second cascode transistor remote from the second current mirror transistor, a dimensioning of the current mirror and cascode transistors for a current in the input current path, which corresponds at least substantially to the n-fold value of the current in the output current path, and a current splitting circuit for deriving a part of a current from the first circuit point in the output terminal, characterized in that n is larger than 1, the current splitting circuit is adapted to split up the current from the first circuit point directly to the output terminal and a reference point in a ratio of m:1, in which the relation $m=1/(n-1)$ is at least substantially satisfied for m.

2. A current mirror arrangement as claimed in claim 1, characterized in that the current splitting circuit comprises a transistor arrangement having a first and a second current path, both of which are connected at one end to the first circuit point, the first current path is connected at the other end to the reference point and the second current path is connected at the other end to the output terminal, while the current paths are dimensioned for a ratio of the currents conveyed thereby of m:1 between the second and the first current path.

3. A current mirror arrangement as claimed in claim 2, characterized in that the first current path of the current splitting circuit is constituted by the main current path of a first splitting transistor, and the second current path of the current splitting circuit is constituted by the main current path of a second splitting transistor, and in that the first and the second splitting transistor are interconnected in a current mirror configuration and their control terminals are connected to the input terminal.

4. A current mirror arrangement as claimed in claim 2, characterized in that the first and the second current path in a transistor are formed with two main current paths and a common control terminal, and the control terminal is connected to the input terminal.

5. A current mirror arrangement as claimed in claim 3, characterized in that the transistors are bipolar transistors.

6. A current mirror arrangement as claimed in claim 5, characterized in that the emitter and collector areas of the first current mirror transistor and the first cascode transistor correspond to the n-fold value of the emitter and collector areas of the second current mirror transistor and the second cascode transistor, and in that the emitter and collector areas arranged in the first and the second current path of the current splitting circuit are chosen in a mutual ratio of 1:m.

* * * * *